US011052651B2

(12) United States Patent
Yan

(10) Patent No.: US 11,052,651 B2
(45) Date of Patent: Jul. 6, 2021

(54) HOT FOIL STAMPING DEVICE INCLUDING A MOBILE WINDOW APPARATUS

(71) Applicant: Bobst (Shanghai) Ltd., Shanghai (CN)

(72) Inventor: Roy Yan, Shanghai (CN)

(73) Assignee: Bobst (Shanghai) Ltd., Shanghai (CN)

( * ) Notice: Subject to any disclaimer, the term of this patent is extended or adjusted under 35 U.S.C. 154(b) by 337 days.

(21) Appl. No.: 16/360,227

(22) Filed: Mar. 21, 2019

(65) Prior Publication Data

US 2019/0291489 A1 Sep. 26, 2019

(30) Foreign Application Priority Data

Mar. 22, 2018 (CN) ..... 201810239926.4

(51) Int. Cl.
*B41F 1/60* (2006.01)
*B41F 13/00* (2006.01)
(Continued)

(52) U.S. Cl.
CPC ..... *B41F 13/0024* (2013.01); *B41F 1/60* (2013.01); *B41F 16/0046* (2013.01);
(Continued)

(58) Field of Classification Search
CPC ..... B41F 1/60; B41F 1/62; B41F 1/64; B41F 13/0024; B41F 16/0046; B41F 33/0018;
(Continued)

(56) References Cited

U.S. PATENT DOCUMENTS 2,488,257 A * 11/1949 Anderson ..... E05F 5/003 49/120
3,758,989 A * 9/1973 Rompa ..... B66B 13/06 49/120

(Continued)

FOREIGN PATENT DOCUMENTS

CN 206426642 U 8/2017
EP 2316646 A1 * 5/2011 ..... B41F 33/0018

(Continued)

*Primary Examiner* — Leslie J Evanisko
(74) *Attorney, Agent, or Firm* — Bookoff McAndrews, PLLC

(57) ABSTRACT

The invention relates to a mobile window apparatus and a hot foil stamping device including the apparatus. The mobile window apparatus comprises at least one first window portion, the first window portion movable in a first direction; at least one second window portion movable in a second direction different from the first direction; and an actuating means configured to move the first window and the second window, respectively; wherein said actuating means moves said first window portion and said second window portion between a closed position and an open position, in said open position, said first window portion and said second window portion being spaced apart from each other to form an access opening, and in said closed position, the first window portion and the second window portion are close to each other so as to substantially shield the access opening and to keep a gap between the first window portion and the second window portion for passing through a sheet material for processed.

10 Claims, 3 Drawing Sheets

(51) Int. Cl.

| | |
|---|---|
| ***B44B 5/00*** | (2006.01) |
| ***B41F 16/00*** | (2006.01) |
| ***B41F 33/00*** | (2006.01) |
| ***B41J 29/12*** | (2006.01) |
| *B41K 3/66* | (2006.01) |

(52) U.S. Cl.
CPC ..... *B41F 33/0018* (2013.01); *B41J 29/12* (2013.01); *B44B 5/0052* (2013.01); *B41K 3/66* (2013.01); *B41P 2219/00* (2013.01); *B41P 2233/20* (2013.01)

(58) Field of Classification Search
CPC ..... B41J 29/12; B41J 29/13; B41P 2219/20; B41P 2219/22; B41P 2219/23; B41P 2233/20; E05F 15/57; E06B 3/443; E06B 3/44; E06B 3/42
USPC ..... 101/27, 479, 480; 400/691, 692, 693; 49/116, 118, 120, 121, 123, 366, 370
See application file for complete search history.

(56) References Cited

U.S. PATENT DOCUMENTS

| | | | | |
|---|---|---|---|---|
| 5,704,292 | A | 1/1998 | Rebeaud | |
| 5,718,172 | A * | 2/1998 | Ruckmann | B41F 7/12 101/177 |
| 7,162,835 | B1 * | 1/2007 | Manpuku | E05F 15/00 49/116 |
| 2002/0148162 | A1 * | 10/2002 | Epps | E05F 1/025 49/123 |
| 2006/0236883 | A1 * | 10/2006 | Kundgen | B41F 35/00 101/425 |
| 2013/0174752 | A1 | 7/2013 | Badoux | |

FOREIGN PATENT DOCUMENTS

| | | | | |
|---|---|---|---|---|
| EP | 2743087 | A1 * | 6/2014 | B41J 3/4073 |
| TW | 201628493 | A | 8/2016 | |

* cited by examiner

HOT FOIL STAMPING DEVICE INCLUDING A MOBILE WINDOW APPARATUS

CROSS-REFERENCE TO RELATED APPLICATION(S)

This application claims the benefit of priority under 35 U.S.C. § 119 from Chinese Patent Application No. 201810239926.4, filed on Mar. 22, 2018, the contents of which is incorporated by reference in its entirety.

TECHNICAL FIELD

This invention relates to the field of packaging and printing, in particular to a hot foil stamping device with a mobile window apparatus.

BACKGROUND OF INVENTION

In the packaging industry, hot foil stamping devices are widely used. The conventional hot stamping device includes a transparent window, which can be opened for loading and unloading the molded board. During usage of the hot foil stamping device, the window is closed, so that an operation space is isolated from outside, which plays a protective role.

There are two foil-conveying modes in a hot foil stamping device: a horizontal foil conveying mode and a longitudinal foil conveying mode. An operator of the device can choose a suitable mode according to requirements of production.

In the existing hot foil stamping device, when the longitudinal foil conveying mode is selected, the window can be completely closed so as to provide a reliable protection. However, when the horizontal foil conveying mode is selected, the window of the existing hot foil stamping device is moved upwardly to closed to a lower surface of the foil, and thus, a large open area is left above an upper surface of the foil, which renders a potential risk during production, and foreign objects may easily enter the operation area of the hot foil stamping device, which may impair a hot stamping quality.

Therefore, there is a need to make an improvement to the existing mobile window apparatus to enhance safety and product quality.

SUMMARY OF INVENTION

To overcome the existing deficiency in the hot foil stamping device, a mobile window apparatus for a hot foil stamping device, comprising: at least one first window portion, the first window portion movable in a first direction; at least one second window portion movable in a second direction different from the first direction; and an actuating means configured to move the first window and the second window, respectively; wherein said actuating means moves said first window portion and said second window portion between a closed position and an open position, in said open position, said first window portion and said second window portion being spaced apart from each other to form an access opening, and in said closed position, the first window portion and the second window portion are close to each other so as to substantially shield the access opening and to keep a gap between the first window portion and the second window portion for passing through a sheet material for processed.

According to one aspect of the invention, the mobile window apparatus is provided with a stop, which abuts against at least one of the first window portion and the second window portion so as to keep the gap for passing through a sheet material for processed.

According to another aspect of the invention, the stop is provided on one of the first window portion and the second window portion.

According to another aspect of the invention, the second window portion is located below the first window portion, the first window portion moves in the first direction vertically upward and the second window portion moves in the second direction vertically downward.

According to another aspect of the invention, the actuating means comprises: an actuator connected to one of the first window and the second window; and a linkage mechanism connected between the first window and the second window.

According to another aspect of the invention, the actuator comprises at least one of a pneumatic cylinder, a hydraulic means and a motor.

Preferably, the linkage mechanism comprises at least one of a cable, a pulley, a link mechanism and a sliding member.

According to another aspect of the invention, the actuating means comprises: an actuating cylinder connected to the first window; a cable having a first end connected to the first window and a second end connected to the second window; and a pulley around which the cable surrounds.

According to another aspect of the invention, the linkage mechanism includes two sets of cables and pulleys, each of the set is provided at one longitudinal side of opposite sides of the first window portion and the second window portion.

Further, the present invention also provides with a hot foil stamping device comprising the mobile window apparatus as above described, wherein the sheet material is a foil material, which is conveyed in a horizontal foil conveying mode.

When the hot foil stamping device adopts the mobile window apparatus according to the present invention, the window portions can substantially shield the access opening with only the small size of the gap is left, it is possible to avoid the presence of an opening area with potential safety hazard and improve the safety of the device when the horizontal foil conveying is used.

The preferred embodiment of the present invention employs a single actuating cylinder and a linkage mechanism comprised of cables and pulleys that are simple in construction and highly reliable in operation.

BRIEF DESCRIPTION OF THE DRAWINGS FIG

LIST OF REFERENCES

Figure 1:
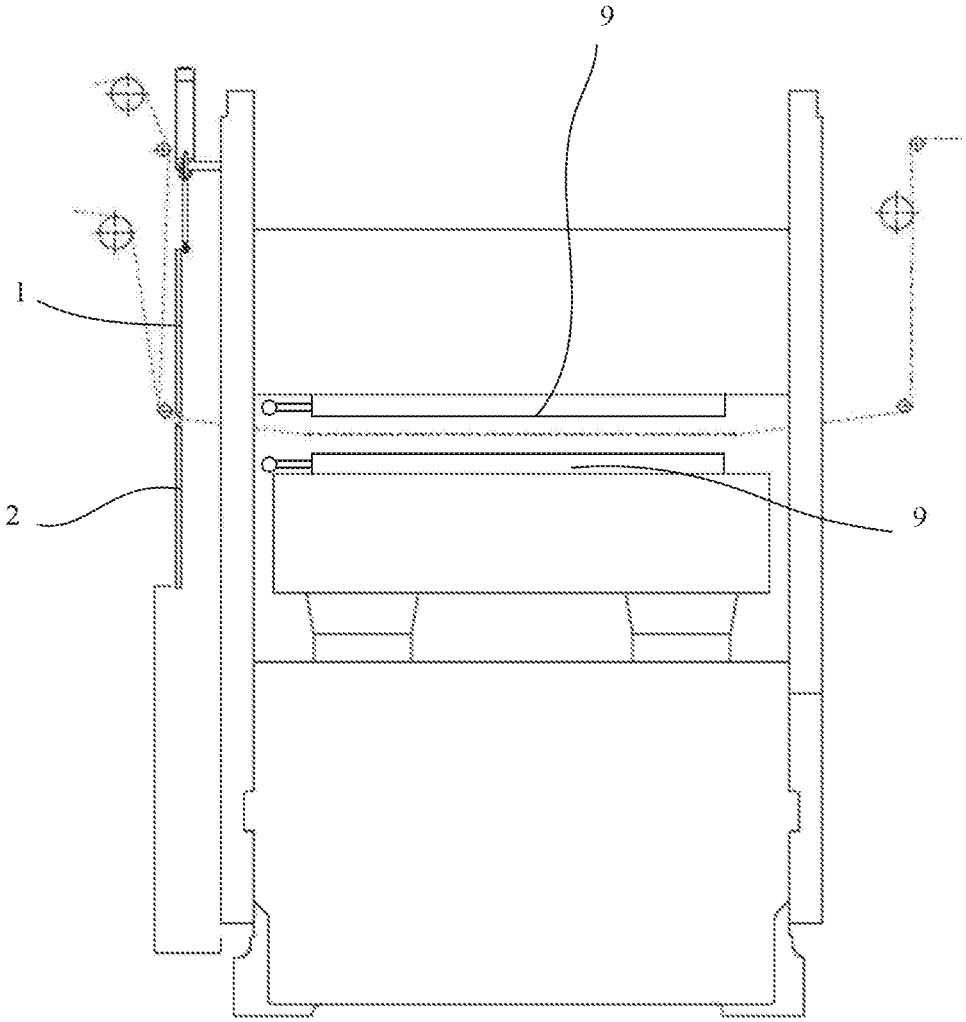
FIG. 1 shows a schematic view of a hot foil stamping device with a mobile window apparatus according to the invention.

1 first window
2 second window
3 foil material
4 actuating cylinder
42 actuating rod

5 pulley
6 cable
7 stop
8 gap
9 the upper and lower platens
10 mobile window apparatus

DETAILED DESCRIPTION OF THE EMBODIMENT

Hereinafter, the present invention will be described further in conjunction with particular embodiments and accompanying drawings. More details are illustrated in the following description for sufficient understanding of the present invention, however, the present invention can be implemented in many other manners different from what is described here obviously. A person skilled in the art can make similar promotions and deductions without departing from the essence of the present invention as required and thus the protection scope of the present invention shall not be limited by the disclosure of these particular embodiments.

FIG. 1 is a schematic illustration of a hot foil stamping device with a mobile window apparatus 10 according to the invention, in which the foil material is conveyed with a horizontal foil conveying mode, i.e., the foil material passes horizontally between upper and lower platens and passes through a gap 8 between a first window portion 1 and a second window portion 2 of the mobile window apparatus 10.

In particular, the mobile window apparatus 10 according to a preferred embodiment in the present invention comprises a first window portion 1 and a second window portion 2, both of which are movable. It can be seen from FIG. 2A and FIG. 3A that the first window portion 1 and the second window portion 2 are rectangular, which have similar size and shape, the first window portion 1 and the second window portion 2 are stacked, and the first window portion 1 is disposed above the second window portion 2, that is, a lower frame of the first window portion 1 is disposed above an upper frame of the second window. The number and shape of the first window portion 1 and the second window portion 2 are not limited to the illustrated examples. For example, the size of two windows may be set according to a height of the foil conveyed horizontally. Each of the window portions 1 and 2 generally has an outer frame and a transparent window supported by the outer frame for observing operation of the hot foil stamping device.

Figure 2B:
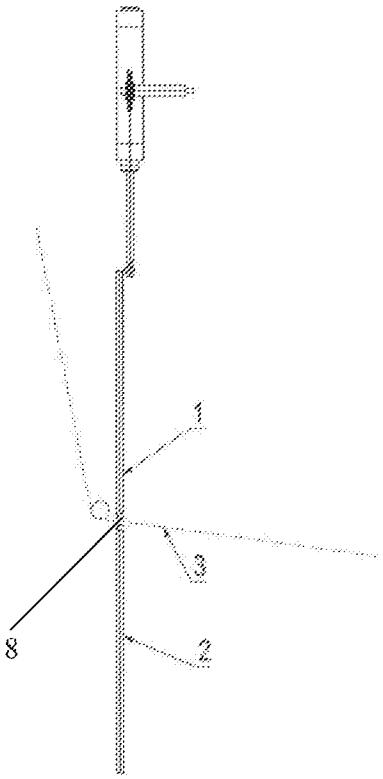
FIG. 2B shows a side view of the mobile window apparatus according to the invention in a closed state.
Figure 2A:
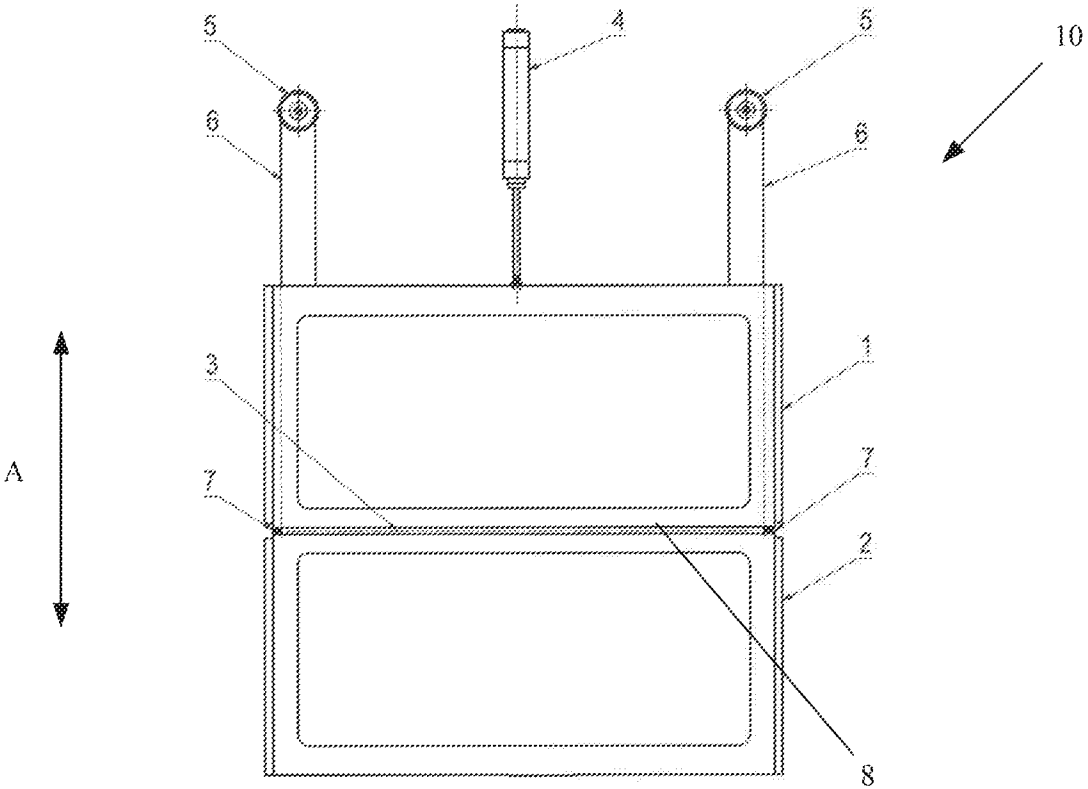
FIG. 2A shows a front view of the mobile window apparatus according to the invention in a closed state.

The mobile window apparatus 10 further includes an actuating means configured to move the first window portion 1 and the second window portion 2, respectively. The actuating means can at least move the first window portion 1 and the second window portion 2 between a closed position and an open position. In the open position, the first window portion 1 and the second window portion 2 are spaced apart from each other for form an access opening, through which the operator can assemble and disassemble the upper and lower platens 9 in the device. A size of the opening can be modified depending on the devices. In the closed position, the first window portion 1 and the second window portion 2 are close to each other to substantially shield the access opening while keep a gap 8 between the first window portion 1 and the second window portion 2 for passing through the foil material. The gap 8 is sized below 10 cm, preferably, it is sized in a range of 1-2 cm, and most preferably, it is sized in a range of 0.5-1 cm, its size ensures that the foil material 3 can pass, but the user's hand or foreign matter cannot easily enter. As shown in FIG. 2A, the gap 8 is horizontal and extends along an entire length of the horizontal sides of the rectangular first window portion 1 and second window portion 2.

Figure 3B:
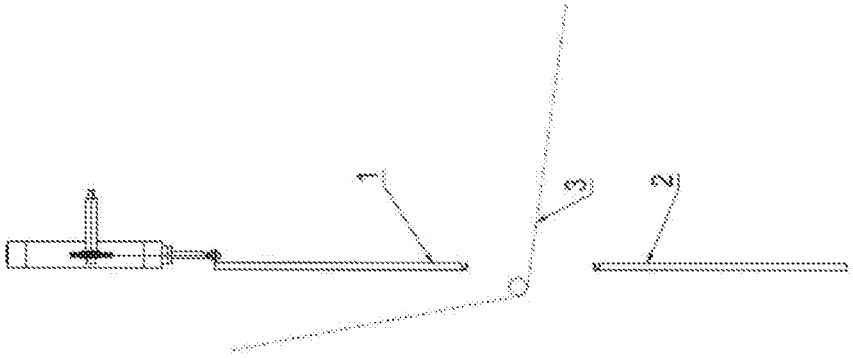
FIG. 3B shows a side view of the mobile window apparatus according to the invention in an open state.
Figure 3A:
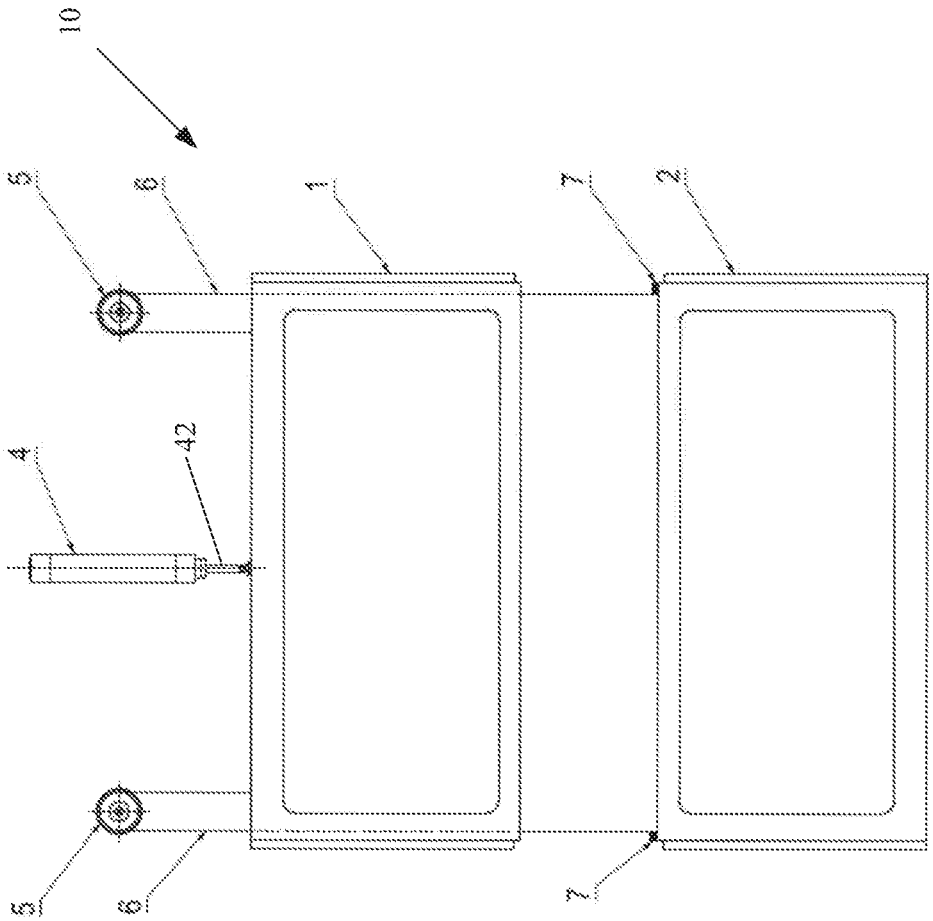
FIG. 3A shows a front view of the mobile window apparatus according to the invention in an open state.

In order to keep the gap 8 between the two windows portion 1 and 2, a stop 7 as gap-keeping means is provided on the second window portion 2 according to the preferred embodiment of the invention. As shown in FIG. 3A, there are two stops 7, which are disposed on two ends of the upper frame of the second window portion 2, respectively. Alternatively, the stops 7 may be disposed on both ends of the lower frame of the first window portion 1. The stop 7 can for example be made of a cushioning material such as rubber. In addition, the stop 7 may also be formed on a portion of a body of the hot foil stamping device that engages with the frame of the window. The stop 7 is preferably detachable, which not only facilitates replacement of the stop 7 if it is damaged, but also allows the size of the gap 8 between the two window portions to be changed by replacing a stop 7 having a different size.

The actuating means of the mobile window apparatus 10 is preferentially configured such that the two windows portions 1 and 2 move synchronously in different directions. In particular in the embodiment, the two windows portions 1 and 2 are moved along the opposite vertical directions as shown in arrow A in FIG. 2A, wherein the upper first window portion 1 is moved vertically upward while the second lower window portion 2 is moved vertically downward, so as to gradually enlarge the size of the gap 8.

The actuating means may include an actuator connected to one of the first window portion 1 and the second window portion 2; and a linkage mechanism connected between the first window portion 1 and the second window portion 2. The actuator may comprise at least one of a pneumatic cylinder 4, a hydraulic means, a motor and a handle, and the linkage mechanism may comprise at least one of a cable 6, a pulley 5, a connecting rod and a sliding member. Alternatively, the actuating means may also comprise two actuators, which are respectively coupled to the first window portion 1 and the second window portion 2, both actuators are able to move the window portions 1 and 2 synchronously with a controller in the hot foil stamping device.

As shown in FIGS. 2A, 2B, 3A and 3B, in the preferred embodiment of the present invention, the actuating means comprises an actuating cylinder 4 connected to the first window portion 1. Specifically, the cylinder 4 is located above the center of the upper side of the first window portion 1, and an actuating rod of the cylinder 4 protrudes downwardly and is fixed to the upper side of the first window portion 1. The linkage mechanism in the actuating means comprises a pulley 5 around which the cable 6 surrounds. As shown in FIGS. 2A and 3A, there are two sets of cables 6 and pulleys 5, respectively, on opposite longitudinal sides of the window. The pulleys 5 are located above the first window portion 1 and are substantially at the same height. The cable 6 bypasses the pulley 5, one end of the cable 6 is connected to the first window portion 1, and the other end of the cable 6 is connected to the second window portion 2.

When the cylinder 4 is actuated to retract the actuating rod, the first window portion 1 is pulled up vertically. When the actuating rod is fully retracted into a cylinder body of the cylinder 4, the first window portion 1 stops into its open position. With the movement of the first window portion 1, the second window portion 2 connected to the first window portion 1 by the cable 6 moves in the opposite vertical downward direction due to its gravity, and when the first window portion 1 stops into its open position, the second window portion 2 also stops into its open position, as shown in FIGS. 3A and 3B. When the cylinder 4 is actuated to cause the actuating rod to protrude downward, the first window portion 1 is pushed to move vertically downward, and meanwhile, the second window portion 2 is pulled to move vertically upward by the cable 6 until the lower frame of the first window portion 1 directly contacts the stops 7 provided on the second window portion 2, then the first window portion 1 is no longer moved, a gap 8 is kept between the first window portion 1 and the second window portion 2 through which the foil material 3 can pass, as shown in FIGS. 2A and 2B.

The mobile window apparatus 10 also has other modification.

The movement of the first window portion 1 and the second window portion 2 are not limited to the above embodiment. The first window portion 1 and the second window portion 2 may also be opened by rotation. For example, the first window portion 1 is pivoted on both sides of the upper frame, the lower frame of the first window portion 1 is rotated upwardly to open, and a pivoting shaft of the second window portion 2 is provision on both sides of its lower frame, the lower frame of the first window portion 1 is rotated downwardly to open, so that the access opening will be formed.

Correspondingly, the actuating means can also adopt other forms. For example, the actuating means for rotating the window portions can adopt a rotary electric motor. The two window portions are operated by two independent actuators, each of which comprise at least one of a pneumatic cylinder, a hydraulic means, a motor and a handle. In addition, the linkage mechanism may be provided on a connecting rod mechanism or a rack-and-pinion mechanism connected between the two window portions, and when one of the window portions is actuated by the actuating cylinder 4, the other of the window portion is moved in a different direction synchronously by means of the connecting rod mechanism or the rack-and-pinion mechanism.

When the hot foil stamping device adopts the mobile window apparatus 10 according to the present invention, the window portions can substantially shield the access opening with only the small size of the gap 8 is left, it is possible to avoid the presence of an opening area with potential safety hazard and improve the safety of the device when the horizontal foil conveying is used.

The above mobile window apparatus 10 is described as an example provided in the hot foil stamping device. For reasons, such a mobile window apparatus 10 is also applicable to other packaging devices that need to pass a sheet material through the window portion.

The preferred embodiment of the present invention employs a single actuating cylinder 4 and a linkage mechanism comprised of cables and pulleys that are simple in construction and highly reliable in operation.

Although the present invention is disclosed as above with preferred embodiments, the present invention is not limited thereto and a person skilled in the art may make possible variations and modifications without departing from the spirit and scope of the present invention. Thus, any modifications, equivalent changes and variations made to the above embodiments according to the technical essence of the present invention without departing from the disclosure of the technical solution of the present invention all fall into the protection scope defined by the claims of the present invention.

The invention claimed is:

1. A hot foil stamping device including:

a mobile window apparatus comprising:

at least one first window portion movable in a first direction;

at least one second window portion movable in a second direction different from the first direction; and an actuating means configured to move the first window portion and the second window portion, respectively;

wherein said actuating means moves said first window portion and said second window portion between a dosed position and an open position, in said open position, said first window portion and said second window portion being spaced apart from each other to form an access opening, and in said closed position, the first window portion and the second window portion are close to each other so as to shield the access opening and to keep a gap between the first window portion and the second window portion for passing through a foil material for processing.

2. The hot foil stamping device including the mobile window apparatus of claim 1, wherein the mobile window apparatus is provided with a stop, which abuts against at least one of the first window portion and the second window portion so as to keep the gap for passing through the foil material for processing.

3. The hot foil stamping device including the mobile window apparatus of claim 2, wherein the stop is provided on one of the first window portion and the second window portion.

4. The hot foil stamping device including the mobile window apparatus of claim 1, wherein the second window portion is located below the first window portion, the first window portion moves in the first direction that is vertically upward and the second window portion moves in the second direction that is vertically downward.

5. The hot foil stamping device including the mobile window apparatus of claim 1, wherein the actuating means comprises:

an actuator connected to one of the first window portion and the second window portion; and a linkage mechanism connected between the first window portion and the second window portion.

6. The hot foil stamping device including the mobile window apparatus of claim 5, wherein the actuator comprises at least one of a pneumatic cylinder, a hydraulic means, a motor, and a handle.

7. The hot foil stamping device including the mobile window apparatus of claim 5, wherein the linkage mechanism comprises at least one of a cable, a pulley, a link mechanism, and a sliding member.

8. The hot foil stamping device including the mobile window apparatus of claim 5, wherein the actuator comprises:

an actuating cylinder connected to the first window portion; and wherein the linkage mechanism comprises:

a first cable having a first end connected to the first window portion and a second end connected to the second window portion; and a first pulley around which the first cable is wound.

9. The hot foil stamping device including the mobile window apparatus of claim 8, wherein the linkage mechanism further comprises:

a second cable having a first end connected to the first window portion and a second end connected to the second window portion; and a second pulley around which the second cable is wound, wherein the second cable and the second pulley are provided at an opposite longitudinal side of the first window portion and the second window portion from the first cable and the first pulley.

10. The hot foil stamping device including the mobile window apparatus of claim 1, wherein the foil material is conveyed in a horizontal foil conveying mode.

* * * * *